US008888096B2

(12) United States Patent
Campion et al.

(10) Patent No.: US 8,888,096 B2
(45) Date of Patent: Nov. 18, 2014

(54) BLOCKING MECHANISM FOR AMUSEMENT GAME

(75) Inventors: Donald C. Campion, Commerce Township, MI (US); Xiwen Jiang, Shanghai (CN)

(73) Assignee: Mega Mania Diversions, LLC, Commerce Township, MI (US)

( * ) Notice: Subject to any disclaimer, the term of this patent is extended or adjusted under 35 U.S.C. 154(b) by 352 days.

(21) Appl. No.: 13/165,020

(22) Filed: Jun. 21, 2011

(65) Prior Publication Data

US 2011/0309574 A1 Dec. 22, 2011

Related U.S. Application Data

(60) Provisional application No. 61/356,772, filed on Jun. 21, 2010.

(51) Int. Cl.

| | |
|---|---|
| ***A63F 7/00*** | (2006.01) |
| ***A63F 7/07*** | (2006.01) |
| ***A63D 1/02*** | (2006.01) |
| ***A63D 3/00*** | (2006.01) |
| *A63F 7/30* | (2006.01) |

(52) U.S. Cl.

CPC ..... *A63F 7/0005* (2013.01); *A63F 2007/309* (2013.01); *A63F 2250/14* (2013.01); *A63F 7/30* (2013.01)

USPC ..... 273/108; 273/118 R; 273/118 A; 273/126 R; 273/126 A; 473/116

(58) Field of Classification Search

CPC ..... A63F 7/0005; A63F 2250/14; A63F 7/30; A63F 2007/309

USPC ..... 273/317.3, 397, 126 R, 126 A, 108, 273/118 R, 118 A; 473/480, 481, 106, 115, 473/116, 4, 24

See application file for complete search history.

(56) References Cited

U.S. PATENT DOCUMENTS

| | | | | | |
|---|---|---|---|---|---|
| 4,013,292 | A | * | 3/1977 | Cohen et al. | 273/371 |
| 4,126,217 | A | * | 11/1978 | Bock | 194/291 |
| 4,215,863 | A | * | 8/1980 | Kuiper | 273/126 R |
| 4,805,917 | A | * | 2/1989 | Cochran et al. | 273/397 |
| 5,011,147 | A | * | 4/1991 | Thomas et al. | 273/126 A |
| 5,199,598 | A | * | 4/1993 | Sampson | 221/194 |
| 5,330,175 | A | * | 7/1994 | Kim | 273/397 |
| 5,556,093 | A | * | 9/1996 | Lankiewicz et al. | 273/126 A |
| 5,704,612 | A | * | 1/1998 | Kelly et al. | 273/402 |
| 5,842,699 | A | * | 12/1998 | Mirando et al. | 273/317.3 |
| 6,536,770 | B1 | * | 3/2003 | Yang | 273/317.3 |
| 2012/0142458 | A1 | * | 6/2012 | He et al. | 473/480 |

* cited by examiner

*Primary Examiner* — Sebastiano Passaniti

(74) *Attorney, Agent, or Firm* — Marshall & Melhorn, LLC

(57) ABSTRACT

A blocking mechanism for a table-type amusement game, and a table type amusement game equipped with a blocking mechanism. The blocking mechanism utilizes a blocking bar which goes from a closed position, which blocks a playing piece from scoring to an open position, which permits the playing piece to score. The blocking mechanism may be manually or electrically operated. When the blocking mechanism is electrically operated, it may be activated by the insertion of a coin into a coin and/or bill acceptor of the type found on table-type amusement games.

20 Claims, 3 Drawing Sheets

BLOCKING MECHANISM FOR AMUSEMENT GAME

RELATED APPLICATION

This application is claiming the benefit, under 35 U.S.C. 119(e), of the provisional application filed Jun. 21, 2010, under 35 U.S.C. 111(b), which was granted Ser. No. 61/356,772. This provisional application is hereby incorporated by reference.

FIELD OF THE INVENTION

The present invention relates to amusement games. More particularly, the present invention relates to table-type amusement games. Most particularly, the present invention relates to a blocking device which will prevent the table-type amusement game from being played without the payment of the fee for playing the game.

BACKGROUND OF THE INVENTION

For as long as there have been amusement table games, there have been efforts on the part of certain people who wish to use the amusement game table to play the game without the payment of the required fee. The present invention provides a solution to this long felt need in the art.

Previous solutions for this type of problem have been relatively expensive. For example, for shuffleboard type table games there has been known in the art a mechanism that does not release the shuffleboard pucks to the player until the fee is deposited, and then does not return the puck to the player once the game is completed. Similarly, for bowling table-type games, a bowling ball will not be released to the player until the fee is deposited, and then after a certain number of frames, the ball will not be returned to the player. Due to the expense and complexity of the mechanism needed to accomplish this, those skilled in the art continue to search for a simple and less expensive solution to the problems in the art.

SUMMARY OF THE INVENTION

The present invention provides a novel and unique solution to the above-mentioned problems in the art by providing an automatic blocking mechanism which prevents the playing piece of table-type amusement games, such as tabletop bowling and tabletop shuffleboard, from being played without payment of the requisite fee. A blocking means, such as a blocking bar, or blocking rod or other blocking device, which is operated upon depositing the fee into a coin and/or bill acceptor of a tabletop amusement game, remains in its closed position before the fee is deposited, opens when the fee is deposited, and closes again after the game is completed, whether by a certain event occurring, such as the playing of a certain number of innings, frames, etc., elapsing of a certain amount of time, or other events.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

Figure 1:
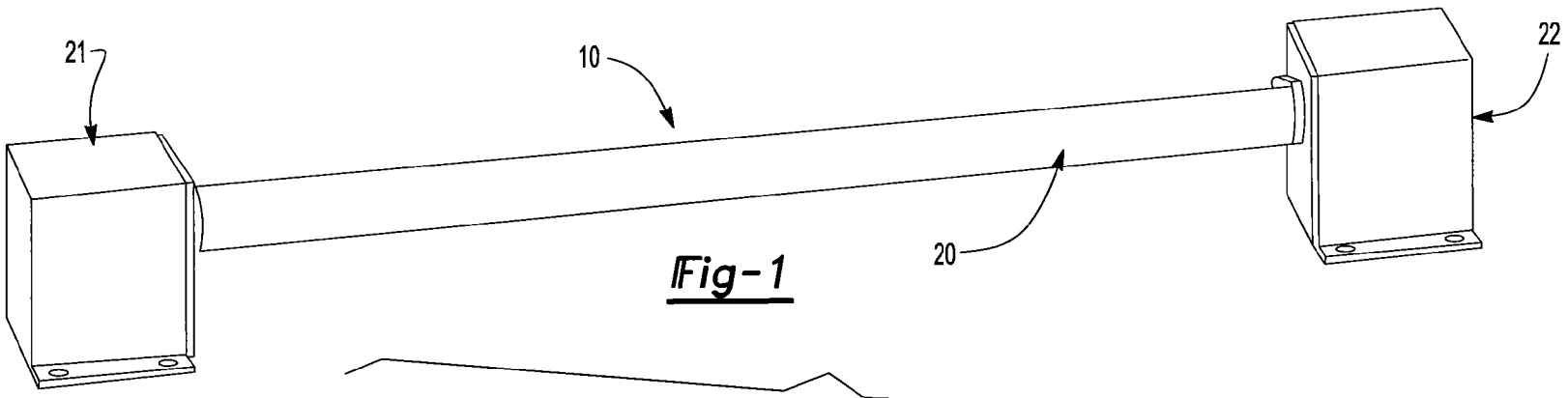
FIG. 1 is a perspective view of a construction embodying the present invention.

Referring to FIG. 1, there is shown a construction embodying the present invention. The blocking mechanism, generally designated by the numeral 10, comprises a blocking means, such as a blocking bar 20, rotatably mounted to a rotation means, which may comprise a motor box 21 and a pivot box 22. The blocking bar 20 is mounted at one end to the motor box 21, and at its other end to the pivot box 22.

Figure 4:
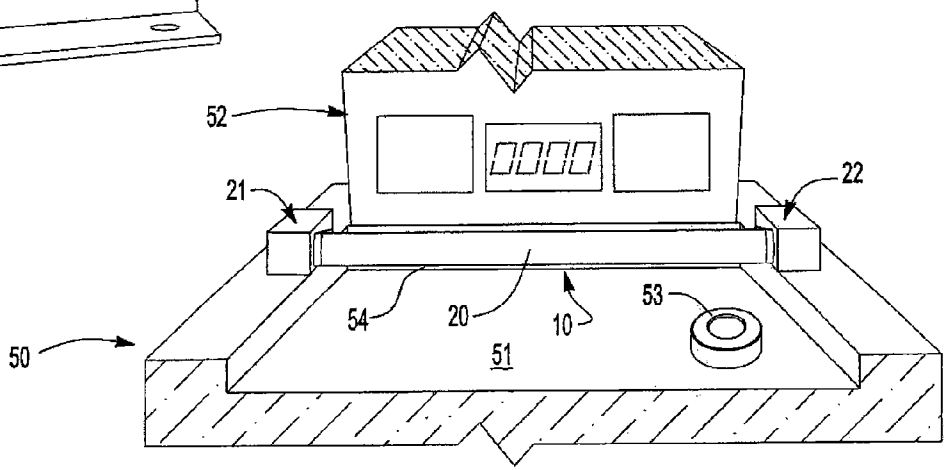
FIG. 4 is a front perspective view showing the construction of FIG. 1 mounted immediately in front of the bumper bar on a shuffleboard game and showing the pivot box mounted adjoining one side of a planar surface, and a motor box mounted adjoining the other side of the planar surface, with the blocking bar extending between the motor box and the pivot box, thereby extending across the entire playing surface.

In a preferred embodiment, when the motor box 21 and the pivot box 22 are axially aligned, the blocking bar 20 may rotate. The motor box 21 and the pivot box 22 may be mounted in any desired position with respect to the table type amusement game on which it is used, but it is preferred that they be mounted adjoining the playing surface as shown in FIG. 4. It can be understood by those skilled in the art that various types of joints or flexible connections may be used between the blocking bar 20 and the motor box 21 and/or pivot box 22.

Additionally, the blocking bar 20 may be made in any desired configuration to adapt the blocking mechanism 10 to a particular table-type game. For example, if a table-type bowling game were to have a blocking mechanism 10 mounted thereon, the blocking bar 20 may have suitable protuberances (not shown) at each end to fit in the "gutters" of the game. Those skilled in the art will be able to adapt the blocking mechanism 10 to virtually any table-type game.

Figure 2:
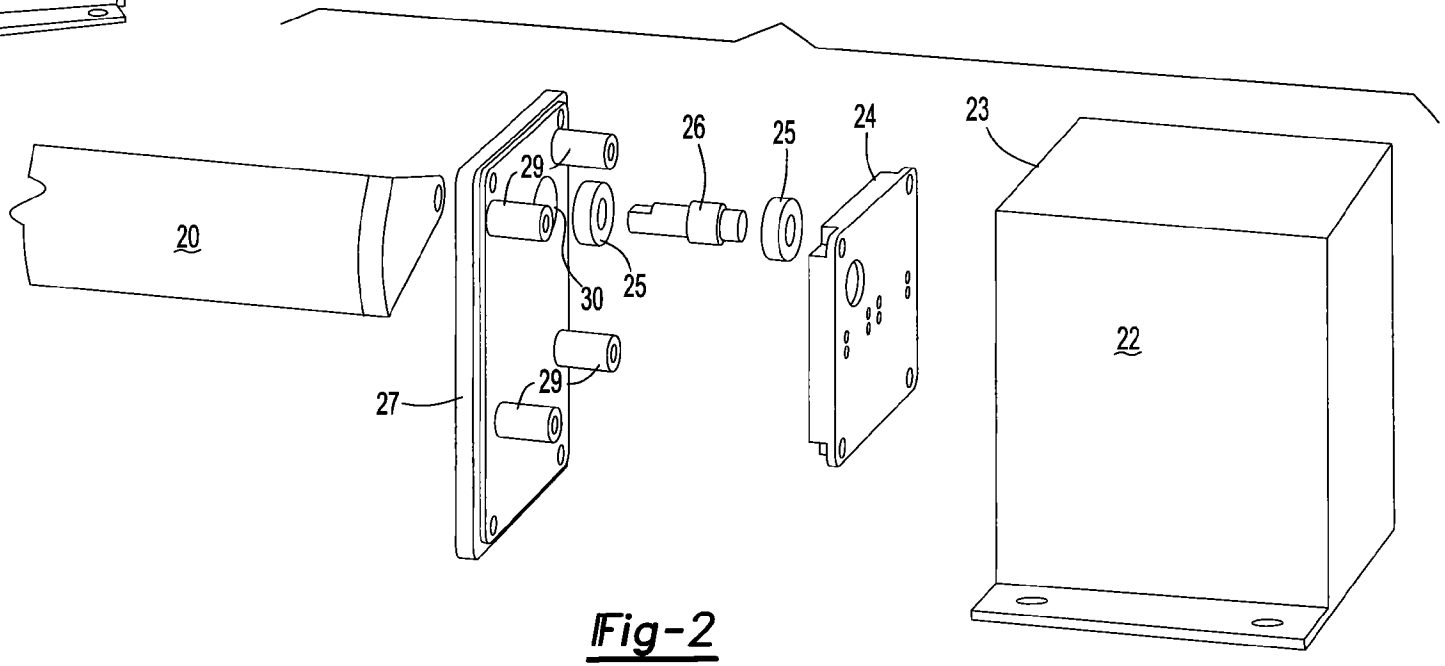
FIG. 2 is an exploded perspective view of one end of the construction shown in FIG. 1 comprising a pivot box.

With reference to FIG. 2, there is shown an exploded, view of the right-hand end of the construction shown in FIG. 1. The pivot box, generally designated by the numeral 22, comprises a cabinet 23, which is closed by a front end plate 27. Four mounting pegs 29 extend axially inwardly of the front end plate 27 and provide for the mounting of a middle plate 24 by means well known in the art (not shown).

Between the front end plate 27, and the middle plate 24, are a pair of bearings 25 which rotatably capture a driven shaft 26, which extends through an aperture 30 in the front end plate 27 and provides for mounting the blocking bar 20 to the shaft 26.

Figure 3:
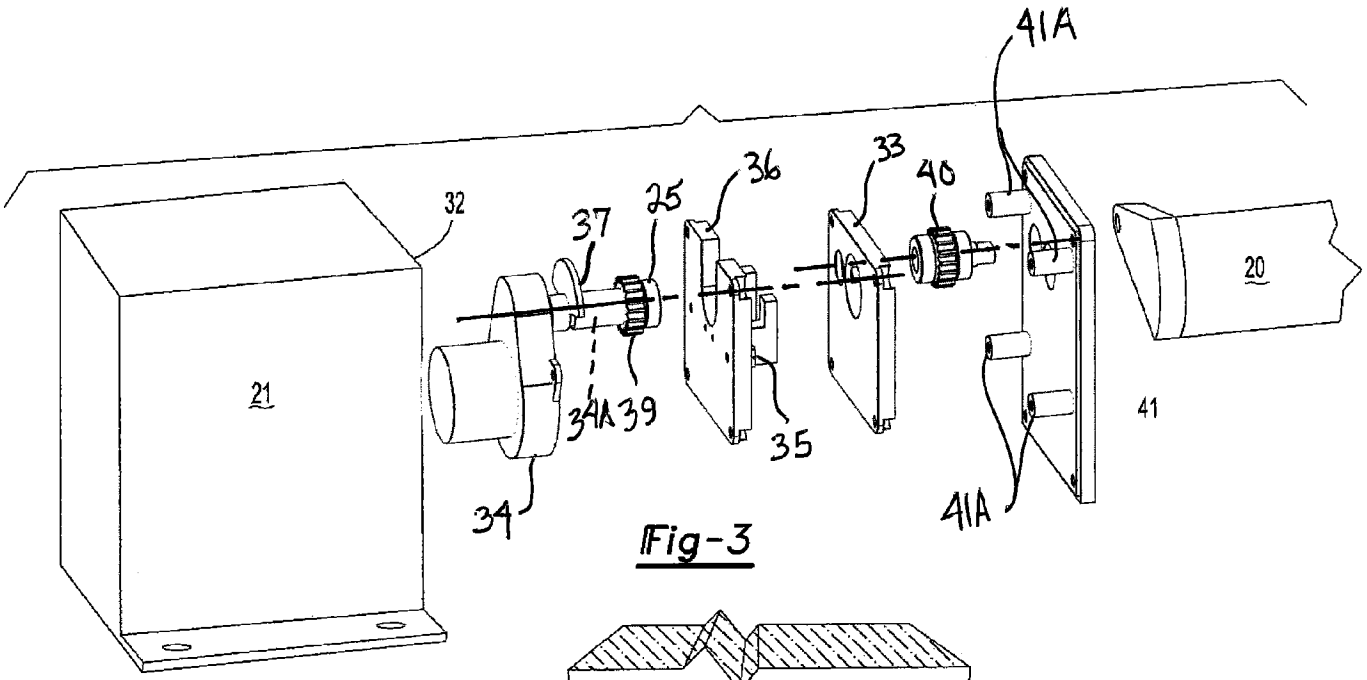
FIG. 3 is an exploded view of the other end of the construction shown in FIG. 1 comprising a motor box.

Referring to FIG. 3, there is shown an exploded view of the other end of the construction shown in FIG. 1. The motor box, generally designated by the numeral 21, comprises a second cabinet 32 which is closed by a second front end plate 41. A motor 34 is mounted to a mounting plate 36, and the motor shaft 34A carries a fan-shaped coupling 37 between the mounting plate 36 and a driven gear plate 33. A plurality of shaft mounting bearings 25 provide for rotatably mounting a driven gear 40 and a driving gear 39.

The driving gear 39 is driven by the motor shaft 34A through the fan-shaped coupling 37. The driving gear 39 drives a driven gear 40 which, in turn, is connected to the blocking bar 20. Four extensions 41A are provided on the second front end plate 41 to provide for the mounting of the driven gear plate 33 and the mounting plate 36. The second front end plate 41 and the driven gear plate 33 capture there between the plurality of bearings 25, and the driven gear 40. When the motor shaft 34A rotates, the blocking bar 20 will rotate. A pair of photoelectric switches 35 is provided for limiting the rotation of the blocking bar 20 by cooperation with the fan shaped coupling. Power will be supplied to the motor 24 and the photoelectric switches 35, by means well known in the art.

Figure 5:
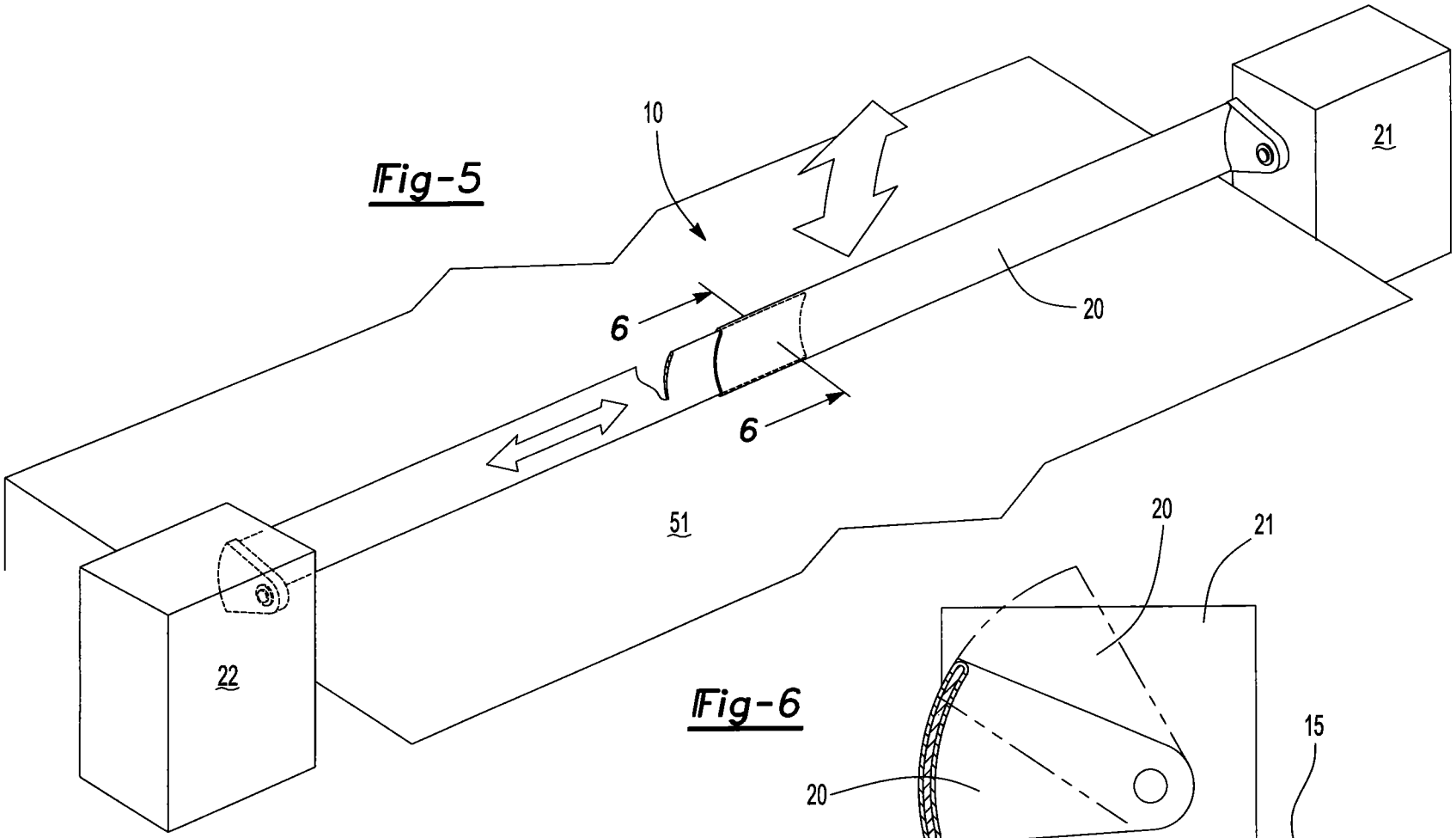
FIG. 5 is a rear perspective view of the construction shown in FIG. 4, with the blocking bar closed, so that a game piece, such as a shuffleboard puck, would be blocked by the blocking bar from hitting the bumper pad.
Figure 6:
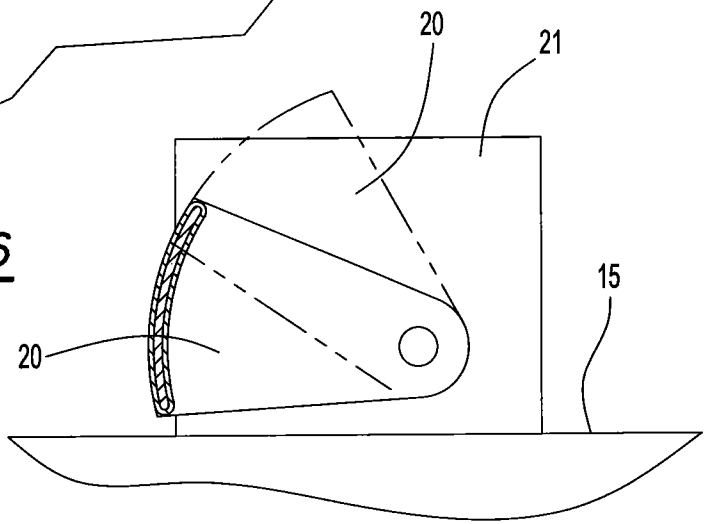
FIG. 6 is a sectional view, taken in the direction of the arrows, along the section line 6-6, of FIG. 5.

With reference to FIGS. 4-6, there is shown a construction embodying the present invention. The blocking mechanism 10 comprising the blocking bar 20, the motor box 21, and the pivot box 22, is shown mounted on a shuffleboard game table, generally designated by the numeral 50, comprising a playing surface 51 and a scoreboard 52. The blocking bar 20 is shown in its closed position in FIGS. 4-5, preventing the shuffleboard puck 53 from passing under the blocking bar 20 and impacting the bumper pad 54.

A coin and/or bill acceptor will accept the players money and start the rotation means rotating the blocking bar 20 between a first (closed) position and a second (open) position where the shuffleboard puck 53 may be played. After the occurrence of a pre-determined event, the rotation means will rotate the blocking bar 20 to its' closed position, which will block the puck 53 from being played. until additional money is inserted into the coin and/or bill acceptor (not shown). If the player has scored, the player's score will appear on the scoreboard 52. Sufficient knowledge is possessed by those skilled in the art to provide power to, and coordinate the operation of the blocking mechanism 10, the scoreboard 52 and the coin and/or bill acceptor.

With reference to FIG. 6, there is shown a sectional view taken through the blocking bar 20, and showing the blocking bar 20 in its open position in phantom lines.

While the present invention is illustrated in connection with a shuffleboard game, it is well within the scope of the present invention that it be used on the many types of amusement games which are coin-operated, and have a playing surface.

By carefully investigating the problems present in the art concerning obtaining payment for amusement games, we have developed a unique and novel invention which solves many problems in the art.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed:

1. In combination a table type amusement game having a playing surface and a blocking mechanism consisting of:

a) the playing surface comprising a single planar surface, b) a means for activation;

c) a means for rotation mounted adjoining the playing surface and connected to the means for activation, and wherein said means for rotation rotates between a first position and a second position upon the operation of the means for activation; and d) a means for blocking extending across the entire planar surface and connected to the means for rotation to rotate the means for blocking between a first closed position and a second open position, wherein when the means for blocking is in the closed position it blocks a playing piece from travelling the full length of the single planar playing surface.

2. The mechanism described in claim 1, wherein the means for blocking is a blocking bar.

3. The mechanism described in claim 1, wherein the means for blocking is a blocking rod.

4. The mechanism described in claim 1, wherein the means for blocking is a blocking device.

5. The mechanism described in claim 1, where the means for activation is manual.

6. The mechanism described in claim 1, wherein the means for activation is electrical.

7. In combination a table type amusement game having a playing surface and a blocking mechanism comprising:

a) a coin and/or bill acceptor;

b) a means for rotation mounted adjoining the playing surface and connected to the coin and/or bill acceptor such that the means for rotation rotates between a first position and a second position upon the depositing of a coin or bill into the coin and/or bill acceptor; and c) a means for blocking extending across the entire playing surface and connected to the means for rotation such that the means for rotation can rotate the means for blocking between a first closed position and a second open position, whereby when the means for blocking is in the closed position it blocks a playing piece from travelling the full length of the playing surface.

8. The table type amusement game described in claim 7, wherein the means for rotation is electrically connected to the means for accepting coin and/or bill.

9. A table type amusement game comprising, in combination:

a) a playing surface lying entirely within a single plane;

b) a playing piece;

c) a means for accepting coin and/or bill;

d) a means for rotation mounted adjoining the playing surface and connected to the means for accepting coin and/or bill such that the means for rotation rotates between a first position and a second position upon the depositing of a coin or bill into the means for accepting coin and/or bill; and e) a means for blocking connected to the means for rotation such that the means for rotation can rotate the means for blocking between a closed position and an open position, wherein when the means for blocking is in the closed position it blocks the playing piece from travelling the full length of the playing surface.

10. The table type amusement game described in claim 9, wherein the means for rotation is operated electrically.

11. The table type amusement game described in claim 9, wherein when the means for blocking is in its first position, a playing piece is blocked from scoring.

12. The table type amusement game described in claim 9, wherein when the means for blocking is in its second position, a playing piece may score.

13. The table type amusement game described in claim 9, wherein the first position is the closed position.

14. The table type amusement game described in claim 9, wherein the second position is the open position.

15. The table type amusement game described in claim 9, wherein the means for blocking is a blocking bar.

16. The table type amusement game described in claim 9, wherein the means for blocking is a rod.

17. The table type amusement game described in claim 9, wherein the playing piece is a shuffleboard puck.

18. The table type amusement game described in claim 9, wherein the playing piece is a bowling ball.

19. The table type amusement game described in claim 9, wherein the means for rotation is operated electrically.

20. The table type amusement game described in claim 9, wherein the means for rotation is operated mechanically.

* * * * *